US006709472B1

(12) United States Patent
Ferretti et al.

(10) Patent No.: US 6,709,472 B1
(45) Date of Patent: Mar. 23, 2004

(54) INSOLUBLY BOUND PARTICULATE PRODUCTS

(76) Inventors: Arthur Ferretti, deceased, late of Sun City Center, FL (US); Louise C. Wilt, legal representative, 5209 Branch Ave., Tampa, FL (US) 33603

( * ) Notice: Subject to any disclaimer, the term of this patent is extended or adjusted under 35 U.S.C. 154(b) by 0 days.

(21) Appl. No.: 09/522,849

(22) Filed: Mar. 10, 2000

(51) Int. Cl.[7] ..... C10L 5/00

(52) U.S. Cl. ..... 44/553; 44/554; 44/596; 44/620

(58) Field of Search ..... 44/553, 554, 596, 44/620

(56) References Cited

U.S. PATENT DOCUMENTS

| | | | | | |
|---|---|---|---|---|---|
| 4,322,219 | A | * | 3/1982 | Burns | 44/626 |
| 4,586,936 | A | | 5/1986 | Schaffer et al. | |
| 4,738,685 | A | | 4/1988 | Goleczka et al. | |
| 4,787,913 | A | | 11/1988 | Goleczka et al. | |
| 4,863,485 | A | | 9/1989 | Schaffer et al. | |
| 4,865,691 | A | | 9/1989 | White | |
| 4,981,494 | A | * | 1/1991 | Breuil | 44/560 |
| 5,328,567 | A | | 7/1994 | Kinsley, Jr. | |
| 5,371,194 | A | | 12/1994 | Ferretti | |
| 5,543,164 | A | | 8/1996 | Krochta et al. | |
| 5,582,682 | A | | 12/1996 | Ferretti | |
| 5,658,357 | A | * | 8/1997 | Liu | 44/550 |
| 5,670,056 | A | | 9/1997 | Yoon et al. | |
| 5,766,331 | A | | 6/1998 | Krinski et al. | |
| 6,013,116 | A | * | 1/2000 | Major et al. | 44/551 |
| 6,344,078 | B1 | * | 2/2002 | Beall et al. | 106/285 |

OTHER PUBLICATIONS

Union Carbide, Polyox Water–Soluble Resins. 12 pp Brochure, UC–876, May 1995, Danbury,CT.

* cited by examiner

*Primary Examiner*—Cephia D. Toomer
(74) *Attorney, Agent, or Firm*—George W. Wasson

(57) ABSTRACT

The novel features of this invention include a bio-based binding-agent and a manufacturing process which—together with conventional production equipment—comprise a very low-cost system for making strong and water-insoluble products from a variety of particulate feedstocks, including finely-divided lignocellulosic fiber and particles, or fines, of chemically-inert materials. This binding-agent—process combination is uniquely suited to the manufacture of water-impermeable agglomerates from granular and powdery materials—including minerals, metal particles and carboniferous fines no courser than about one cm—and to creation of composite materials from particulated forestry residues, crop wastes and paper byproducts. Of particular commercial interest is the production of synthetic fuel from moist fine coal without the input of the thermal energy normally required for dewatering and drying the feedstock, and for curing prior art bonding agents.

23 Claims, 1 Drawing Sheet

Fig. 1 Schematic-Syn-Fuel Manufacture
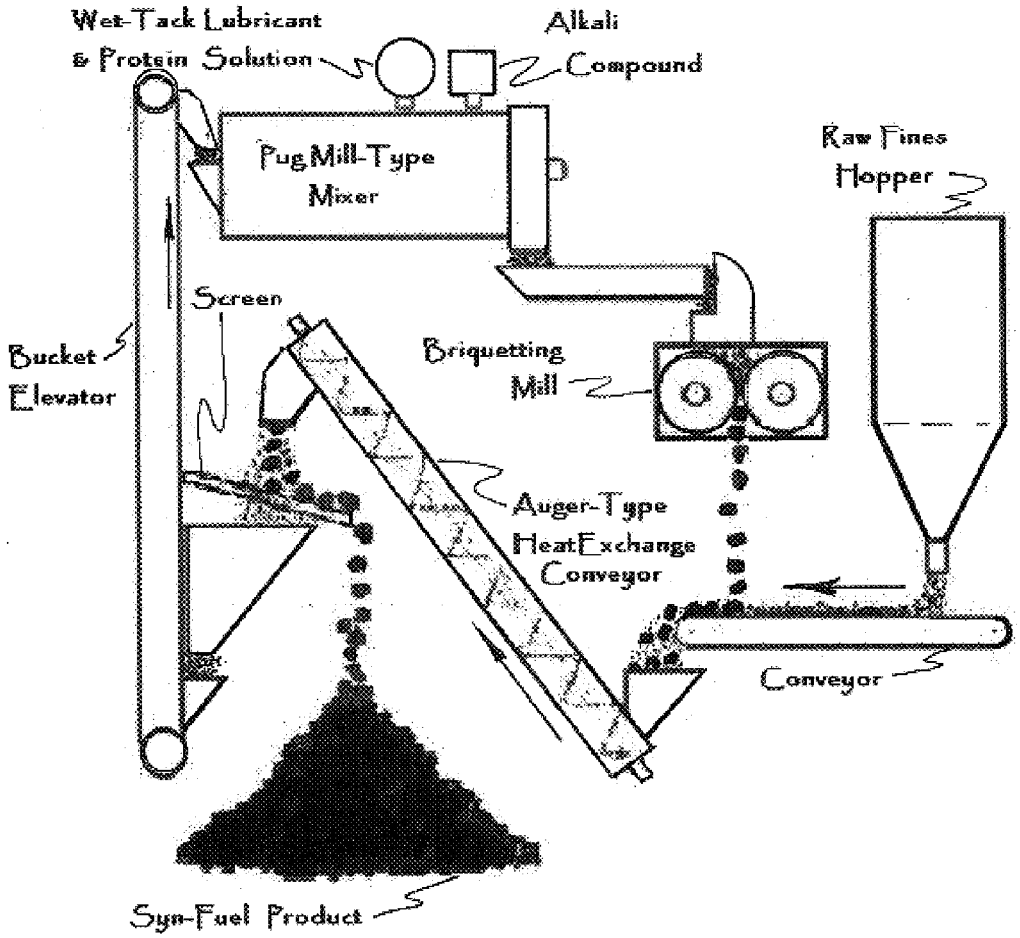

INSOLUBLY BOUND PARTICULATE PRODUCTS

BACKGROUND OF THE INVENTION

This invention relates to a bio-based binding agent that is particularly effective when used in conjunction with a process disclosed herein for making impermeable agglomerates from finely divided minerals, such as coal, and for making insoluble composite materials from particulated lignocellulosics.

Many finely divided but otherwise useful materials are neglected or abandoned merely because they contain unwanted moisture; clearly, a low cost means for bonding such materials into durable products with a permanently reduced moisture content would enhance both their utility and value.

Providing such a means is a principal objective of this invention.

Earlier, attempts were made to adapt techniques disclosed in Applicant's U.S. Pat. No. 5,371,194 "Biomass Derived Thermoset Resin" & U.S. Pat. No. 5,582,682 "Process For Making Cellulosic Composites" to the production of synthetic solid fuel from fines created during the mining of Wyodak coal in the western United States. Although acceptable quality syn-fuel products were made, the cost of energy required to remove all entrained water and to polymerize the binder was prohibitive. These results underscored the need for a less energy-intensive, and altogether cheaper method of making weather-resistant products from particulate materials—a need now satisfied by the technology disclosed herein.

An exceptionally promising embodiment of this invention provides a long-sought alternative to coal mining's most waste-intensive practice—the improvident discard of huge quantities of moisture-laden fine coal. In particular, this synthetic-fuel-making process has the capacity to open a new and profitable outlet for this energy-rich debris—which at present creates environment tensions and financial burdens throughout the coal industry.

The novelty and economic merit of this new syn-fuel-making process, and the bio-based composition on which it relies, are unequivocally established by eliminating the need for the thermal energy invariably required by the prior art to dewater and dry coal fines, and to cure binders. The ability to dewater, shape and bond a variety of particulate feedstocks in a single continuous operation—without the input of thermal energy—is a distinguishing feature of processes employing this new bio-based composition. Coalescing, as used herein, means to quantify, shape, compress and express essentially all free water from a mixture of particulate, a wet-tack lubricant solution and a water-insoluble binding agent. When a chemically-inert particulate is agglomerated, coalescing may include both direct and indirect transfer of heat generated by compressive friction to the incipient agglomerate.

Essential to the dewatering method utilized in this invention is the presence on particulate surfaces of a substance, defined herein as a wet-tack lubricant, in very dilute solution. The preferred wet-tack lubricant is polyethylene oxide (PEO), a non-ionic water-soluble resin particularized by Union Carbide Corporation (UCI), Danbury, Conn. 06817, in brochure UC-876 5/95-5M. Relevant properties of PEO mentioned in the brochure include: "Lubricity, Friction Reduction, Water Thickening, Wet-Tack, and Shear-Thinning, and a high affinity for coal-fines, lignin and paper fines". PEO is known to flocculate lignocellulosics but not hydrophobic coal-fines, and it is hydrophilic but not a surfactant. While it is a relatively new chemical, the use of PEO in coal and paper processing has become extensive.

U.S. Pat. No. 4,322,219 of Burns discloses a process for removing moisture by contacting coal—either run-of-mine or pipeline slurry coal—with a dilute aqueous solution of PEO and allowing the moisture to evaporate; alcohol may be added to accelerate evaporation. The use of PEO solutions to ". . . avoid the tendency of high-moisture low-rank coal to slack or degrade in size . . . " is mentioned; however, no mention is made of small particles, or fines, and no suggestion that PEO could be used to facilitate the forcible expression of water from coal, or coal fines, or that de-watered coal, or coal-fines, could be agglomerated into a fuel product—with or without a binder.

The use of hydrophilic PEO in the process of present invention distinguishes it from U.S. Pat. No. 5,670,056 Yoon et al, which utilizes a hydrophobic reagent—preferably, mono unsaturated fatty esters or polysiloxane polymers—to aid mechanical means for dewatering coal-fines. No treatment beyond the dewatering of fine materials, such as agglomeration or bonding, is mentioned or suggested.

U.S. Pat. No. 5,658,357 of Liu et al. "Process For Forming Coal Compact Without A Binder" uses the surface tension of water and the absence of air-bubbles to furnish". . . a binding effect which holds the carboniferous particles together and imparts mechanical strength in the compact . . . ". If the surface-tension-producing water is removed from such a compact, disintegration quickly follows. Aside from reducing coal-log drag in a pipe line, the sole purpose of using a very dilute solution of PEO is reduction of the zeta potential to lessen electrostatic repulsion between particles in a coal slurry. In the present invention, the hydrophilicity, lubricity, thickening, shear-thinning, and fines affinity of PEO combine to facilitate particulate dewatering, densification and, unexpectedly, bonding during coalition.

Except for pellets made on a disc pelletizer, agglomerates made from mineral particulate by the process of the present invention have no need for the interim strength provided by PEO or supplemental heat; they are inherently insoluble and impermeable and—because they have been subjected to the frictional heat of compressive coalition—strong and durable. But no appreciable heat is produced during disc pelletizing; therefore, although agglomerates made on these machines are impermeable and insoluble, supplemental heat is needed to obtain a peak strength product. As used herein, the terms insoluble and impermeable refer to the behavior of a product or substance with respect to water.

White's U.S. Pat. No. 4,865,691 exploits a unique property of normally insoluble but water swellable polyvinyl alcohol (PVOH) particles: Swollen particles are dispersed in a dilute aqueous suspension of cellulosic fiber which, as excess water is drained, acts as a sieve retaining the swollen PVOH particles within the web. When heated, the entrapped swollen particles melt, dissolve into residual free water and diffuse into the web and, on cooling, solidify into a paper-reinforcing binder.

In U.S. Pat. Nos. 5,498,314, 5,328,567, and 5,800,675, Kinsley describes newer domestic grades of PVOH powder available from Air Products and Chemicals, Inc. (APCI) of Allentown, Pa. and specifies Airvol 125SF, 165SF, 350SF, 107SF, and 325SF as grades will allow the use of larger quantities of PVOH without undesirable side effects. None of the four aforementioned patents specify or suggest the use of PVOH in an unswollen state, or for a purpose other than paper-making.

Because PVOH is employed in a dissolved state as a coal-fines binder in the processes described in U.S. Pat. No. 4,787,913 of Goleczka, et al, and U.S. Pat. Nos. 4,586,936 and 4,863,485 of Schaffer, et al, they are easily distinguished from the present invention, wherein PVOH is used in an undissolved state. Neither swelling or dissolving PVOH powder is necessary to the present invention.

The 'cook-out' (dissolution) temperature of PVOH is specified by the manufacturer, APCI, as below 205° F. (93° C.) for all grades. In addition to the bio-based composition of the present invention and suitable grades of PVOH listed above, there are numerous water-insoluble binding agents, e.g., phenolic, acrylic, epoxy, thermosetting, or thermoplastic resins that melt or become temporarily soluble within the coalition temperature range (150–220° F.) and would, therefore, be technically suitable for this duty. Without exception, however, such plastics have been found to be uneconomic.

Little if any frictional heat is created by the apparatus during coalition of lignocellulosic particulate to melt and disperse the PVOH powder. Product integrity and structural strength on an interim basis—without which the ostensibly-dry composite could not tolerate handling and shaping—must therefore be provided by PEO. For durability and peak strength, the ostensibly-dry composite material must be heated to melt and diffuse the PVOH, preferably while contained in a mold or press.

Coalesced composite material, with interim strength provided by PEO, may also be processed, e.g., molded, rolled, and shaped, and later subjected to heat sufficient to melt and disperse the binding agent, and dry the product. Like many other plasticizers known in the art, a small amount of PVOH will enhance composition tensile strength and flexibility. Likewise, small amounts of various lipids, such as paraffin, paraffin emulsions, and stearates and steric acids, will enhance composite hydrophobicity.

Any substantially water-insoluble PVOH powder hydrolyzed to a super, fully, or intermediate, extent is deemed suitable for use in this invention, with the higher viscosities (22–72 cps) preferred. The utility of undissolved PVOH powder is not mentioned in APCI's brochure, nor is it disclosed in any other prior art. The phrase 'substantially water-insoluble' means a substance that will not dissolve appreciably in water at room temperature, i.e., less than 25% w/w will dissolve in 30 minutes.

The use of soluble protein is old in the art of making paper coatings and adhesives; the process of Krinski, et al, disclosed in U.S. Pat. No. 5,766,331, for making a pigment binder exemplifies such use. In this process, a cation binding agent is added to inhibit formation of the insoluble gel created by addition of calcium oxide, or hydroxide, to a protein solution. This gel—termed herein a bio-based binding agent—is a basic and necessary element of the present invention, from which Krinski, et al, '331 is clearly distinguished by its teaching of the inhibition of gel formation—a contrary instruction.

In U.S. Pat. No. 5,543,164 of Krochta, et al, a method for making edible protein-based insoluble film and coating for foods is described. The present invention is readily differentiated from the process of Krochta et al '164, in which: A solution of denatured protein is applied to the exterior of a food item or made into a food wrapping film—rather than incorporated as a necessary reagent in the composition of an industrial product; and, All means for denaturation, including heat, chemical or enzymatic treatment, may be employed—rather than the addition of calcium oxide or hydroxide, the only means found effective in the present invention. It is believed the alkaline ambiance created in products of the present invention by a relatively large amount of such a calcium compound—in addition to effecting the irreversible denaturation of the protein solution and reducing $SO_x$ emissions during coal combustion—prevents the growth of micro-organisms that would otherwise eventually cause product deterioration.

Inasmuch as the binding agent composition disclosed herein stems from chemistry never previously used to create a particulate binding agent, it is easily distinguished from compositions of the prior art. Specifically, in a mixture of particulate with only a small amount of protein, alkali denaturation transforms the protein in situ into an insoluble gelatinous material—which, during coalition, bonds the particulate and forms a moisture barrier—thereby yielding an insoluble and impermeable agglomerate. Impermeability—which is vital to the ability of syn-fuel to retain a high BTU level and survive all-weather storage and transport—is verified with a simple water-soak test: No weight gain is observed after an agglomerate made by the process of this invention has been immersed in water for 24 hours.

BRIEF SUMMARY OF THE INVENTION

The process of this invention is based on the discovery that a dewatered product with insoluble inter-particle bonds can be obtained when an alkali, such as lime, is admixed with a mixture of moist PEO-treated particulate and a soluble protein, and the resulting admixture is coalesced. As a result of protein denaturation, a gelatinous insoluble substance—which acts as a binding agent and a permanent sealant—is formed in situ in the coalesced product. Following PEO-facilitated dewatering at the outset of particulate coalition, this binding agent provides integrity and strength. If the coalesced particulate is an inert mineral, such as coal fines, the frictional heat that accompanies compressive coalition evaporates residual moisture from the agglomerate making it stronger and more durable—in addition to being insoluble and impermeable.

Use of this procedure with lignocellulosic particulate yields an analogous product; however, because only a negligible amount of frictional heat is generated during cellulosic coalition, supplemental heat is required to obtain a substantially dry composite. Moreover, because the binding agent yields an insoluble but not impermeable composite, moisture can be re-absorbed into the lumens and pores of lognocellulosic—unless such penetration is precluded by the addition of a hydrophobizing ingredient to the feedstock mixture, or application of a water-repellant coating to the composite product.

DESCRIPTION OF THE DRAWING

The drawing, titled FIG. 1 Schematic—Syn-Fuel Manufacture, is a prepresentative arrangement of equipment for making syn-fuel from coal fines and recovering and utilizing a portion of the frictional heat generated during the coalition of finely divided minerals. The basic functions of the equipment shown in the drawing and their method of cooperation are as follows:

- A hopper to feed mineral fines≈1 cm×0 at a measured rate to a conveyor;
- A conveyor to transport the fines and hot coalesced product to a heat exchanger/conveyor.
- An auger-type heat-exchanger-conveyor that effects fines heating and coalesced product transport;

A screen with openings sized to separate the heated fines from the coalesced product;

A bucket elevator to transport the heated fines to a pug-mill type mixer;

A mixer that combines the fines with the wet-tack lubricant solution and binding agent ingredients;

A dispenser that adds a controlled quantity of a solution of a wet-tack lubricant and protein;

A hopper to feed metered amounts of an alkali compound to the mixer; and

A compression-type dewatering and coalition apparatus, such as the briquetting mill indicated.

Operation: When the feedstock is coal fines, the above listed components cooperate to produce a synthetic fuel: Raw moist coal fines are stored in and dispensed from the hopper at a measured rate onto a belt-type conveyor, which transports the fines now co-mingled with a hot coalesced syn-fuel product to an auger-type heat-exchanger-conveyor that effects heat transfer to the fines from coalesced syn-fuel product with a beginning temperature of about 220° F. These 2 materials are churned in the conveyor to expedite fines heating, which is separated by a screen from the syn-fuel product, and then delivered by a bucket elevator to a pug-mill-type mixer, in which it is mixed with metered amounts of a solution of protein and a wet-tack lubricant from a tank and a measured quantity of an alkali compound from a storage bin dispenser. This warm mixture is then fed to and coalesced in a compression-type apparatus, such as the symbolized briquetting mill, which yields a syn-fuel product heated to about 220° F. that is then discharged onto the system conveyor.

It should be noted that many different equipment types, designs and component arrangements can be employed to achieve the desired transfer of heat to the incoming minerals feedstock.

DETAILED DESCRIPTION OF THE INVENTION

The water factor: Many industrial feedstocks are refined or processed in water—a medium present in and native to many raw materials. While water is conducive—and often essential—to many manufacturing operations, including purification, product shaping and reaction chemistry, problems arise when the water in a feedstock or nascent product must be reduced or removed. In raw materials that range from mining debris to industrial and farm byproducts, the amount of water present often dictates whether an otherwise valuable resource will be recovered and productively used—or simply abandoned.

A distinction is often made between 'free' water and the 'inherent', or bound, moisture—that together constitute 'total water'. Because both finely divided lignocellulosics and particles of chemically inert minerals have minute capillaries and pores that hold water tenaciously, no free-water removal procedure (except prolonged thermal treatment) is ever totally effective. But the exact amount of free water in, or expressed from, the particulate mixture is irrelevant to the process of the present invention; in this new process, the amount of free water depends on, and must be adjusted to, the viscosity, or consistency, best suited to the coalition apparatus employed—almost every type of which has a different preferred consistency range. As the term infers, an ostensibly-dry material is dry to the senses but may contain some free water; expressing 'essentially all free water' means expelling from the feedstock an amount of water that will achieve an ostensibly dry condition.

Despite a water content of 30–35%, over 300 million tons of Powder River Basin (PRB) coal—not including fines left at the mine—was produced and sold in Wyoming in 1998 at spot prices $3.25 to 3.75/ton. Because of its low sulfur content, ever-larger amounts of PRB coal is being bought by eastern utilities—although the immured water reduces combustion efficiency, adds non-useful weight, and invites a rail-car & stock-pile freeze-up. These short-comings are tolerated as part of a least-cost solution for achieving compliance with EPA emission limits; $SO_2$ allowances (credits) earned when low sulfur coal is burned are sold or used to offset burning coal with a higher BTU and sulfur content.

An inevitable side effect of expanded mining is a glut of coal fines; an estimated $40\times10^6$ tons of fines were generated last year in Wyoming alone. The disproportionately large amount of water that clings to the surface of very small particles makes the discard of these fines an economic necessity: The cost of drying exceeds the value of the salvaged material! But even if water removal cost was not prohibitive, the ability of PRB coal to rapidly re-absorb moisture from the amtosphere would make drying impractical. Consequently, coal producers are forced to accept the cost of shipping water, and utilities with older, less flexible, equipment must de-rate their boilers to burn this water-laden fuel.

Water-related issues become more acute when coal-fines reconstitution is attempted—not only must moisture be removed to increase the BTU content, the fines must be re-constituted into an insoluble product able to withstand wet and cold weather without fracturing or re-absorbing significant moisture.

The water content and composition of PRB coal fines, as noted in the As Received column of Table 1., coupled with a low market price, make this debris a near-ideal feedstock for syn-fuel. Introduction of this new syn-fuel making process would provide a low cost means for using the entire mined product, and for meeting the ever-more-stringent EPA emission standards and/or obtaining valuable $SO_2$ allowances. An unexpected bonus is provided by the reaction between the coal's sulfur and the alkali of the binding agent, which converts unwanted $SO_2$ gas to gypsum during combustion.

The U.S. Congress addressed the economic barriers confronting new uses of coal with IRS Code §29, which grants tax credits for converting coal to syn-fuel. To qualify a plant for tax credits, a request detailing the new syn-fuel's properties—with scientific evidence of a change in chemical composition—must be approved by the IRS (at 11,000 BTU/lb, this credit is now more than $25/ton).

R&D, tightly focused on meeting the IRS product-qualifying criteria at minimum cost, led to the novel set of innovations that comprise the syn-fuel making process disclosed herein, which will, it is expected, enable the profitable manufacture of syn-fuel from water-laden coal-fines without regard to rank or source—and without tax credits. Surprisingly, the invention was found to embrace not only the agglomeration of particles of chemically-inert materials, such as coal, but the making of composite materials from particulated lignocellulosics. Distinction is made between agglomerates and composites based on how particles are bonded: in the former, particles are bound to each other with a binding agent; in a composite the particles are embedded, or held, within a binding agent matrix. The lignocellulosic residue of field, forest, farm and paper-making often contain an amount of free water—naturally, or added during refining—that makes their use economically marginal or unacceptable.

The term particulate, as it is used herein, means either a finely-divided lignocellulosic fiber with an average length of less than about ¾" with an L/D ratio of no less than about 20, or a particle of a chemically inert substance, i.e., an insoluble, non-reactive, normally infusible material that is no greater than about one cm across. The making of composite materials is described in Applicant's aforementioned U.S. Pat. No. 5,582,682, titled "*A Process and a Composition For Making Cellulosic composites*", which patent in its entirety is incorporated herein by reference.

A key element of this invention—heat-less dewatering—is achieved by treating coal fines with a dilute solution of polyethylene oxide (PEO), a hydrophilic water-soluble polymer. About 150–400 parts PEO (≦1,000,000 molecular weight) per million parts coal (wt), or 0.3–0.8 lbs PEO/ton of coal fines, are needed to facilitate the expression of about 85–97% of the coal's free-water under compressive forces typically found in belt presses, extruders and briquette/pellet mills (200–300 tons). The temperature of syn-fuel exiting a briquetting press driven by a 300 HP motor is about 190–240° F.

TABLE 1

PROXIMATE ANALYSIS & VALUE - WYODAK (PRB) COAL & SYN-FUEL

| Properties | As Received (wt %) | Syn-Fuel-Dry Basis |
|---|---|---|
| Total Moisture | 26.43 | (wt %) |
| Volatile Matter | 30.31 | 41.20 |
| Fixed Carbon | 38.76 | 52.70 |
| Ash | 4.50 | 6.11 |
| Heating Value, BTU/lb (MJ/kg) | 8400 (20.51) | 11,418 (27.88) |
| Inherent Moisture | 15.53 | 15.53 |
| Market Value (mine) $/ton | $3.50 | ≈$14.50 (est.) |

ANALYSIS: The Market Value estimate assumes a 11,000 BTU syn-fuel product with a selling price of about $14.50/ton (mine)-based on a rail-delivery distance equal to coal with the same BTU content from Unita Basin-Colorado. At break-even, a liberal allowance of $8/ton total for binding agent and Wyodak coal fines allows a comfortable margin of $6.50/ton of syn-fuel for other operating costs (labor, energy, repairs, etc, .), leaving the $25/ton tax credit (if available) intact.

The absolute, or effective, amounts of PEO and binding agent required depend on particulate characteristics, such as, particle size and surface area, absorbency and porosity. Although PEO is a known coal-fines dewatering aid, it was never previously used in combination with a particulate binder—presumably because of its solubility and its purported tendency to resist and/or defeat adhesion.

Manufacturing syn-fuel from Wyodak fines should be a profitable enterprise (Table 1., Analysis): A product with ≈15.5% inherent moisture made from fines originally containing 26.4% water would justify an increase of ≈$11/ton, from $3.5/ton to $14.50/ton—based on 8400 BTU/lb coal and syn-fuel at ≈11,000 BTU/lb. At break-even (an unlikely, pessimistic case), a 1 million ton/yr plant would provide a $25 MM tax credit, plus income of $12–14 MM from sales of about a million tons of syn-fuel.

Noteworthy findings made during the development of this invention, include:

- Virtually all free water can be expressed from finely divided particulate—lignocellulosic or mineral—when it is treated with a solution of an appropriate wet-tack lubricant (e.g., PEO);
- An appropriate wet tack lubricant (e.g., PEO), despite its lubricity, does not inhibit the bonding of particulate into an insoluble agglomerate or a composite material;
- Soluble protein, when admixed and coalesced with a mixture of a solution of PEO, mineral particulate and lime, will form insoluble and impermeable interparticle bonds within an agglomerate;
- No heat, except that generated by friction in the coalition apparatus and transferred to the coal fines, is needed to create a merchantable medium-BUT syn-fuel product.

The fundamental objective of this invention is provision of a technically superior and less costly means for dewatering marginal value particulate materials, such as coal fines, and reconstituting such materials into more convenient and valuable forms, e.g., insoluble and impermeable agglomerates of solid synthetic fuel. Subservient objectives include provision of:

- A novel biomass-based binding agent that is useful in the aforesaid reconstitution process and does not entail a heating or drying step per se;
- A process for making a synthetic fuel product from coal-fines ordinarily abandoned;
- A process for making composite materials from marginal value lignocellulosics.

In accordance with the above objectives, this invention provides a novel and low-cost bio-based binding-agent and a new manufacturing process which—together with orthodox production equipment—comprise a unique system for making products from a variety of particulate feedstocks, including finely-divided lignocellulosic fiber and particles, or fines, of chemically-inert minerals.

TABLE 2

SUMMARY: COMPOSITION INGREDIENTS EVALUATED

| | Concentration | Cost (1–10) | Comments | Utility (1–10) |
|---|---|---|---|---|
| I. PROTEIN-RICH INGRED.: | | | | |
| 1. Dairy: a. Whey Pro Concen | P = 34% min | 5 | Regional Supply? | 6 |
| b. Whey Protein Isolate | P = 95% | 9 | " | 9 |
| 2. Agric: a. Soy Bean Flour | P = 34% | 2 | Univ. Available | 7 |
| b. Soy Protein Isolate | P = 93% min | 8 | Specialty Product | 10 |
| c. Soy Protein Concentrate | P ≈ 60% | 4 | Specialty Product | 8 |
| II. INGREDIENT:: ALKALINE: | | | | |
| 1 Sodium/ Potash-Hydroxide | Dry, 100% | 1 | Poor Results | 0 |
| 2. Ammonium Hydroxide | Aqua, 26% | 1 | " | 0 |
| 3. Calcium Hydroxide | Dry, 100% | 1 | Large Amount | 10 |
| 4. Calcium Oxide (Lime) | Dry, 100% | 0.9 | Performs Best | 10 |

Result Summary: From both a cost and utility perspective, Calcium Hydroxide, Oxide, in combination with a soy-bean-derived protein-rich material, preferably, soy bean concentrate, or isolate, in a dry weight ratio of protein to calcium hydroxide of about 12:5, provided the best results. As the percentage of protein in ingredient I., Table 2., decreases, the effectivity of the composition as a binding agent—as indicated by resistance of an agglomerate to water dissolution and penetration—also begins to decrease. A composition comprised of soy bean isolate and common lines was used to obtain the results presented in Table 3., below; the isolate form of soy protein was selected for its high protein concentration and consistent chemical composition. Inexpensive material rich in soluble protein include those derived from dairy products, such as whey, legumes such as soybeans and even the liquid waste by products of the meat packing industry.

TABLE 3

SUMMARY: PARTICULATE BONDING RESULTS

| PARTICULATE MATERIAL | PARTICLE SIZE | A. MOISTURE BEFORE | A. MOISTURE AFTER | COMMENTS & PRODUCT NOTES (N) | | B. WEIGHT GAIN-$H_2O$ | C. WATER TEST INSOLU. | C. WATER TEST IMPERM. |
|---|---|---|---|---|---|---|---|---|
| Wyodak Coal** | 1 cm × 0 | 32% | 15% | Excellent Product | (1) | 0% | X | X |
| Pitts..No. 8 Coal** | −250 mesh | 22% | 11% | " | | 0% | | X |
| Met, Pet Coke** | 3 mm × 0 | 20% | 8% | Hard, Abrasive | (2) | 0% | X | X |
| Swarf; Fe Ore** | 1 cm × 0 | 18% | 6% | Oxidizable Prod | (2, 3) | 0% | X | X |
| Silica Sand** | −100 mesh | 10% | 8% | Hard, Abrasive | (2) | 0% | X | X |
| Wood Fiber; Dust‡ | 5 mm × 0 | ≈30% | 5% | Swells in Water | (4) | 20–30% | X | (5) — |
| Straw; Stover | 2 cm × 0 | ≈40% | 5% | " | (4) | 25% | X | (5) — |
| Paper Mill Sludge‡ | " | ≈55% | 5% | " | (5) | 15% | X | (5) — |

COMMENTS AND PRODUCT NOTES (TABLE 3.):
A. MOISTURE: Total water content measured both before and after coalition is listed.
B. WEIGHT GAIN: By coalesced end product after 24 hour immersion.
C. WATER TEST: Resistance of coalesced product to dissolution in, and penetration by, water.
(1) Examples represent many coal ranks tested; all yielded an excellent, IRS qualified, syn-fuel.
(2) Along with metallic ores, inert listed materials produced hard and very abrasive products.
(3) Due to high pH, these materials are susceptible, after coalition and over time, to oxidation.
(4) Immersed in water, these materials imbibe water, gain weight, and expand linearly, ≈25%.
(5) Inert constituents and fillers reduce swelling tendencies of coalesced sludge.
**Agglomerates were previously made with high temperature process of Ferretti, U.S. Pat. No. 5,371,194.
‡Cellulosic composites previously made with high temperature process of Ferretti, U.S. Pat. No. 582,682.

GENERAL PROCEDURES

INGREDIENTS EVALUATION (TABLE 2.): The consistent composition of soy protein isolate made it the reagent of choice in these trials; only the least expensive, alkaline materials were utilized.

COALESCED PRODUCT TRIALS (TABLE 3.): Excellent products were obtained with all mineral materials; a limitation (i.e., permeability) was observed in the lignocellulosic composites unless a hydrophobizing agent was added to the feedstock mixture, or a coating was applied to the product.

Making insoluble and impermeable medium BTU synfuel briquettes from moist Wyodak (PRB) coal fines with a bio-based binding agent is the preferred embodiment of this invention. It entails mixing an effective amount of the binding agent—composed of lime and soy protein in a dry weight ratio of 5:12, respectively—with coal fines that have been treated with a quantity of an aqueous solution of polyethylene oxide sufficient to facilitate expression of 85–98% of the free water contained in the fines mixture during agglomeration with a briquetting press.

It will be appreciated by those skilled in the art that various changes may be made in the teaching disclosed herein without departing from the spirit of the invention. The invention is not, therefore, to be construed as specific to the disclosed embodiments—which are for the purpose of illustration—but rather is limited only by the scope of the appended claims and their equivalents.

I claim:

1. A process employing a mixture of a binding agent and an aqueous solution of a polyethylene oxide wet-track lubricant having a molecular weight of greater than 200,000 to manufacture an insoluble product from particulate comprising:

admixing said particulate with said mixture to obtain a free-water containing binding agent, lubricant and particulate admixture;

coalescing said admixture to manufacture said product.

2. The process of claim 1 wherein said particulate is selected from the group consisting of finely-divided and chemically-inert minerals, metals and carboniferous materials, or combinations thereof, said binding agent is a bio-based composition or a suitable grade of polyvinyl alcohol, and said lubricant is polyethylene oxide with a molecular weight greater than 200,000.

3. The process of claim 2 wherein said carboniferous material is selected from the group consisting of coal, lignite, charcoal, and metallurgical or petroleum coke, or mixtures thereof, said bio-based composition is comprised of a material rich in soluble protein and an alkali metal oxide, or hydroxide, said lubricant is polyethylene oxide with a molecular weight greater than 1,000,000, and said product is an impermeable synthetic fuel.

4. The process of claim 3 wherein said carboniferous material is coal, said protein-rich material is a dairy byproduct or a soy, gluten, or leguminous isolate, concentrate, or flour, or mixtures of said protein-rich materials, said alkali metal hydroxide is calcium hydroxide or oxide, and said coalition is effected in a belt press, briquetting machine, pellet mill, or combination thereof, which coalition, in addition to yielding an ostensibly dry product, improves the strength and durability of said synthetic fuel by providing heat from compressive friction to evaporate residual free water.

5. The process of claim 3 wherein said carboniferous material is coal, said protein-rich material is a dairy byproduct or a soy, gluten, or leguminous isolate, concentrate, or flour, or mixtures of said protein-rich materials, said alkali metal hydroxide is calcium hydroxide or oxide, said coalition is effected in a disc pelletizer, following which coalition, in an additional process step, suplemental heat is supplied to said coalesced admixture to evaporate free water and thereby improve the strength and durability of said synthetic fuel.

6. The process of claim 1 wherein said particulate is finely-divided wood, straw, bagasse, stover, grass, or re-pulped paper, a paper-mill sludge, or a mixture of said particulate, said binding agent is a bio-based composition or a suitable grade of polyvinyl alcohol, said lubricant is polyethylene oxide with a molecular weight greater than 1,000,000, and said coalition is effected in an injection or shaped mold, sheet press, or on a rolling mill, paper-making wire, calender, or combination thereof, thereby manufacturing an ostensibly dry composite.

7. The process of claim 4, which process includes the additional step of supplying supplemental heat to said ostensibly dry product to evaporate residual free water and manufacture a substantially dry composite.

8. A composite made by the process of claim 7.

9. A manufacturing process employing a mixture of a binding agent, an aqueous solution of a polyethylene oxide wet-tack lubricant and coal fines to manufacture an insoluble synthetic fuel from input feed coal fines, said process including a source of input feed coal fines, a conveyer and heat exchanger, a screening means, a mixer, a source of binding agent and wet-tack lubricant, and a coalition machine, said manufacturing process comprising the steps of:

feeding an initial mixture of said binding agent, wet-tack lubricant and coal fines through said coalition machine which provides heat from compressive friction to evaporate residual water from said mixture and input coal fines and to deliver manufactured compressed heated insoluble synthetic fuel to said conveying and heat exchanger;

then passing said heated insoluble synthetic fuel and input feed coal fines along said conveyor and heat exchanger that conveys said input feed of coal fines and said heated insoluble synthetic fuel to said screening means;

transferring heat from said heated insoluble synthetic fuel to said input coal fines along said conveyor and heat exchanger to obtain pre-heated feed coal fines at said screening means;

separating said pre-heated coal fines and said insoluble synthetic fuel and dispensing said manufactured insoluble synthetic fuel at said screening means after transferring heat to said conveyed feed coal fines to obtain pre-heated coal fines;

admixing said separated pre-heated coal fines with a mixture of said binding agent and wet-tack lubricant to obtain a free-water-containing binding agent, wet-tack lubricant and pre-heated coal fines admixture for feed to said coalition machine;

coalescing said admixture in said coalition machine to manufacture said heated insoluble synthetic fuel for transferring heat to said input coal fines to produce said pre-heated coal fines; and repeating said passing, transferring heat, dispensing, admixing, and coalescing steps to continue manufacture of said insoluble synthetic fuel.

10. The process of claim 9 wherein said binding agent is a bio-based composition, said lubricant is polyethylene oxide with a molecular weight greater than 1,000,000, and said coalition is effected in a belt press, briquetting machine, pellet mill, or extruder, which coalition, in addition to yielding an ostensibly dry synthetic fuel, improves the strength and durability of said fuel by providing heat from compressive friction to evaporate residual free water.

11. A product made from coal fines by the process of claim 10.

12. A mixture consisting of a binding agent and an aqueous solution of a polyethylene oxide wet-tack lubricant.

13. The mixture of claim 12 wherein said binding agent is a bio-based composition or a suitable grade of polyvinyl alcohol, or a mixture thereof, and said wet-tack lubricant is polyethylene oxide with a molecular weight greater than 1,000,000.

14. The mixture of claim 13 wherein said bio-based composition is comprised of a material rich in soluble protein and an alkali metal oxide, or hydroxide, and, optionally, an effective amount of a product flexibility- and strength-enhancing plasticizer compound, or an effective amount of a product hydrophobicity-enhancing lipid compound, or effective amounts of both said product-enhancing compounds.

15. The mixture of claim 14 wherein said protein-rich material is a dairy byproduct or a soy, gluten, or leguminous isolate, concentrate, or flour, or mixtures of said protein-rich materials, and said alkali metal hydroxide is calcium hydroxide or oxide.

16. A single step process for employing a mixture of a binding agent and an aqueous solution of a polyethylene oxide wet-tack lubricant to manufacture an insoluble product from particulate, wherein an admixture of said particulate with said mixture will yield said product when said admixture is subjected to said process step, which step consists of coalescing said admixture.

17. The process of claim 16 wherein said particulate is selected from the group consisting of finely-divided and chemically-inert minerals, metals and carboniferous materials, or combinations thereof, said binding agent is a bio-based composition or a suitable grade of polyvinyl alcohol, or a mixture thereof, said lubricant is polyethylene oxide with a molecular weight greater than 1,000,000, and said coalition is effected in a belt press, briquetting machine, extruder, or pellet mill, or combination thereof, which coalition, in addition to yielding an ostensibly dry product, improves the strength and durability of said product by providing heat from compressive friction to evaporate residual free water.

18. The process of claim 17 wherein said carboniferous material is coal fines, said bio-based composition is a mixture of a protein-rich soy product and calcium hydroxide or oxide, and said product is an impermeable synthetic fuel.

19. Synthetic fuel made by the process of claim 18.

20. An admixture consisting of finely divided and chemically-inert particulate admixed with a mixture of a binding agent and an aqueous solution of a polyethylene oxide wet-tack lubricant, that will, when coalesced, yield a water insoluble product.

21. A process for employing a mixture of a binding agent and an aqueous solution of a polyethylene oxide wet-tack lubricant to manufacture a water insoluble and impermeable product from a finely divided and chemically-inert mineral, consisting of:

admixing said mineral with said mixture to obtain a free-water-containing binding agent, lubricant and mineral particulate admixture, and coalescing said admixture to manufacture said product.

22. The process of claim 21 wherein said lubricant is polyethylene oxide with a molecular weight greater than 1,000,000, said binding agent is a bio-based composition, and said coalescing is effected in a belt press, briquetting machine, extruder, or pellet mill, or combination thereof, which coalition, in addition to providing an ostensibly dry product, improves the strength and durability of said product by providing heat from compressive friction to evaporate residual free water.

23. A process employing a mixture of a particulate, a water insoluble binding agent and an aqueous solution of a wet-tack lubricant for facilitating dewatering residual water within said particulate, said wet-tack lubricant having a molecular weight of greater than 200,000 to manufacture an insoluble product from said particulate comprising:

admixing said particulate with said binding agent and said aqueous solution of wet-tack lubricant to obtain a free-water containing binding agent, lubricant and particulate admixture;

coalescing said admixture to facilitate dewatering residual water within said particulate and to bind said particulate to manufacture said insoluble product.

* * * * *